US006584741B1

(12) United States Patent
Hatzinikolas

(10) Patent No.: US 6,584,741 B1
(45) Date of Patent: Jul. 1, 2003

(54) REINFORCEMENT DEVICE FOR TRUSSES

(75) Inventor: Michael Hatzinikolas, Edmonton (CA)

(73) Assignee: Fero Corporation, Edmonton (CA)

( * ) Notice: Subject to any disclaimer, the term of this patent is extended or adjusted under 35 U.S.C. 154(b) by 0 days.

(21) Appl. No.: 09/577,820

(22) Filed: May 25, 2000

(51) Int. Cl.[7] ..... E04B 7/00; E04C 3/18; B21D 47/01

(52) U.S. Cl. ..... 52/289; 52/693; 29/897.35

(58) Field of Search ..... 52/690, 691, 692, 52/693, 694, 695, 696, 697, 712, 714, 741.1, 741.3, 93.2, 289; 29/897.1, 897.31, 897.34, 897.35

(56) References Cited

U.S. PATENT DOCUMENTS 797,474 A * 8/1905 Walker ..... 52/93.2
4,047,352 A * 9/1977 Sweet ..... 52/693
4,930,809 A * 6/1990 Lindsay ..... 52/693
5,640,822 A * 6/1997 Haswell ..... 52/712

* cited by examiner

*Primary Examiner*—Michael Safavi
(74) *Attorney, Agent, or Firm*—Aikins, MacAulay & Thorvaldson; Murray E. Thrift

(57) ABSTRACT

A method for strengthening a truss having a principal rafter and a plurality of struts coupled to the principal rafter, defining a frame structure of the truss. The method includes the use of a bracket which is coupled between the principal rafter and one of the struts. The bracket includes a channel arranged to receive and mount the rafter therein. A strut anchor is coupled to the channel and extends outwardly therefrom for anchoring the channel on an outermost strut defining an end of the truss. The bracket provides torsional support and load bearing support between the strut and the principal rafter.

13 Claims, 2 Drawing Sheets

REINFORCEMENT DEVICE FOR TRUSSES

FIELD OF THE INVENTION

This invention relates to a method for reinforcing a wooden truss using a reinforcement device comprising a bracket which is mounted on a principal rafter of the truss and anchored to the truss.

BACKGROUND

In the construction of buildings, it is common practice to construct a roof of a building by suspending wood trusses between respective top ends of opposing pairs of load bearing walls of the building. Each truss is an elongate structure having a principal rafter with mounting portions at respective ends thereof. The mounting portions extend past respective ends of the truss for being supported on the respective load bearing walls. Generally a small bearing offset between one or both ends of the truss and the corresponding load bearing wall is permitted, however if this offset is too large, the strength of the truss becomes significantly reduced and premature failure may occur. It is generally not known however if the bearing offset is within, tolerance until the truss has been assembled and installed. To ensure that the truss meets its design strength, the truss must then be reconstructed if the bearing offset is too great, which involves an undesirable waste of material and labour.

SUMMARY

According to one aspect of the present invention there is provided a reinforcement device for use with an elongate wooden truss having a principal rafter extending longitudinally with the truss and past respective ends thereof, the device comprising:

a channel for receiving the principal rafter therein;

channel mounting means for mounting the channel on the principal rafter such that the principal rafter is engaged therein;

a rigid anchor secured to the channel and extending outwardly therefrom;

and anchor mounting means for mounting the anchor on the truss.

When an elongate truss having a principal rafter extending past respective ends of the truss is mounted on a supporting structure and the bearing offset exceeds a recommended tolerance, the reinforcement device of the present invention can be mounted on the truss to ensure that the truss meets its design strength. The device is mounted on the truss by securing the channel on the principal rafter between an end of the truss and the supporting structure supporting a corresponding end of the principal rafter thereon such that the channel spans the bearing offset therebetween. By subsequently securing the anchor to the truss, for example one of the struts of the truss, the reinforcement device provides torsional and load bearing support between the end of the principal rafter and the end of the truss to assist the truss in meeting its design strength.

There may be provided a mounting face on the anchor for engaging a side of the truss, wherein the channel includes an engaging face which extends perpendicularly to the mounting face for engaging a top side of the principal rafter. The orientation of the engaging face permits at least a portion of the channel to be supported on a top side of the rafter such that the channel mounting means do not support the entire load transferred between the rafter and the channel. When the channel mounting means comprises a set of fasteners for example, the fasteners are not required to support the entire load in shear.

Preferably, the channel has a C-shaped cross section including a base member and a pair of side flanges extending therefrom which are parallel and spaced apart for engaging opposing sides of the principal rafter such that the rafter is secured therebetween. The channel is thus able to transfer torsional loads between the principal rafter and the truss without relying on the channel mounting means due to the secure fit of the rafter within the channel which is engaged on three sides thereof.

When there is provided a mounting face on the anchor for engaging a side of the truss, the channel is preferably oriented such that the base member is substantially parallel to the mounting face of the anchor. The orientation of the channel ensures that at least portion of the channel is arranged to be supported on the top side of the rafter for assisting the channel mounting means in transferring loads from the principal rafter to the truss.

The anchor mounting means are preferably spaced from the channel. The spacing of the anchor mounting means from the channel assists in transferring torsional loads from the channel to the truss while subjecting the anchor mounting means to minimal stress therefrom.

The channel and the anchor preferably comprise an elongate rectangular plate which has been bent to define the channel and the anchor respectively. The device is thus simple to manufacture at minimal cost.

The channel mounting means and the anchor mounting means preferably comprise at least one aperture in the channel and the anchor respectively for receiving a corresponding fastener therethrough. The use of fasteners, for example screws or bolts, allows the reinforcement device to be readily installed in the field using conventional tools.

According to a second aspect of the present invention there is provided a truss for supporting a roof on a supporting structure, the truss comprising:

an elongate frame structure;

a principal rafter extending longitudinally with the frame structure and past respective ends thereof, defining a pair of mounting portions located at respective ends of the principal rafter for supporting the rafter on the supporting structure;

a channel mounted on one of the mounting portions of the principal rafter and securing the rafter therein; and a rigid anchor extending between and secured to the channel and the frame structure.

There may be provided a channel mounted at each end of the principal rafter, each channel having an anchor mounted thereon for coupling to the frame structure.

When the frame structure includes a plurality of struts such that an outermost pair of the struts define the respective ends of the frame structure, the anchor is preferably mounted on one of the outermost struts. The outermost struts may each comprise an upright post or an inclined support member.

The channel preferably comprises a clamp member of C-shaped cross section having a base and a pair of flanges extending therefrom for engaging respective sides of the principal rafter.

The channel preferably includes an engaging face which is engaged on a top side of the principal rafter.

According to a further aspect of the present invention there is provided a method of reinforcing an elongate truss having an elongate principal rafter extending longitudinally with the truss past respective ends of the truss, the method comprising:

providing a bracket having a channel arranged to receive the principal rafter therein and an anchor for anchoring the bracket on the truss;

mounting the channel on the principal rafter between an end of the truss and an end of the rafter; and mounting the anchor on the truss.

The method preferably includes mounting the channel on the rafter such that a portion of the channel engages a top side of the rafter.

When the truss includes a plurality of struts coupled to the principal rafter, the method preferably includes mounting the anchor on an outermost strut adjacent the corresponding end of the rafter mounting the channel thereon.

When the principal rafter is supported at respective ends on a supporting structure, the method preferably includes selecting a channel having a width which is substantially equal to a spacing between one end of the truss and the supporting structure before the channel is mounted therebetween.

BRIEF DESCRIPTION OF THE DRAWINGS

In the accompanying drawings, which illustrate exemplary embodiments of the present invention.

DETAILED DESCRIPTION

Figure 2:
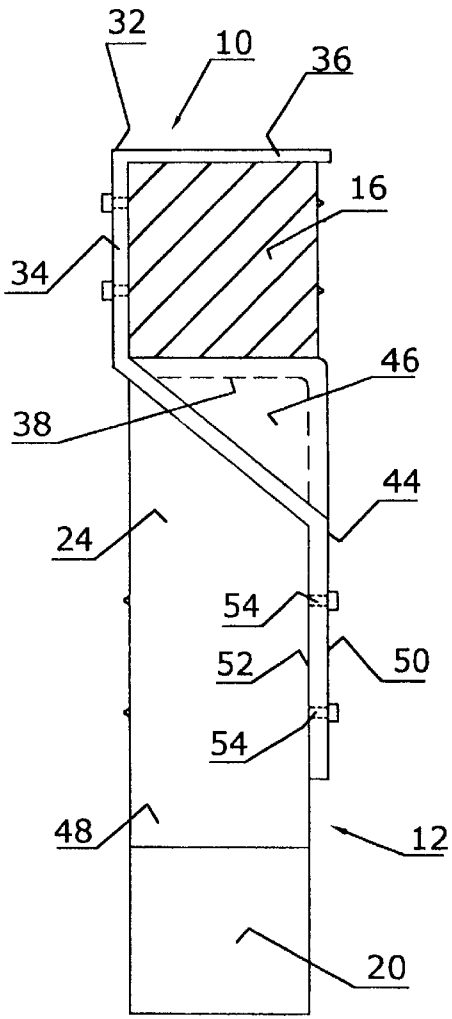
FIG. 2 is an end view along the line 2—2 of FIG. 1.

Referring to the accompanying drawings, there is illustrated a bracket generally indicated by reference numeral 10. The bracket 10 is for use on a wooden truss 12 which is supported at respective ends on a supporting structure for example a wall 14.

The wooden truss 12 includes a principle rafter 16 which comprises an elongate member of rectangular cross section which extends between respective ends 18 thereof. A beam 20 extends longitudinally with the rafter spaced there below, being coupled to the rafter by a plurality of struts 22 and upright posts 24 which define a frame structure.

The frame structure extends longitudinally with the rafter between respective ends 26 of the frame structure which are spaced inwardly from the ends 18 of the principle rafter. The rafter thus defines a pair of mounting portions 28 extending past respective ends of the frame structure for suspending the trust therefrom.

Figure 1:
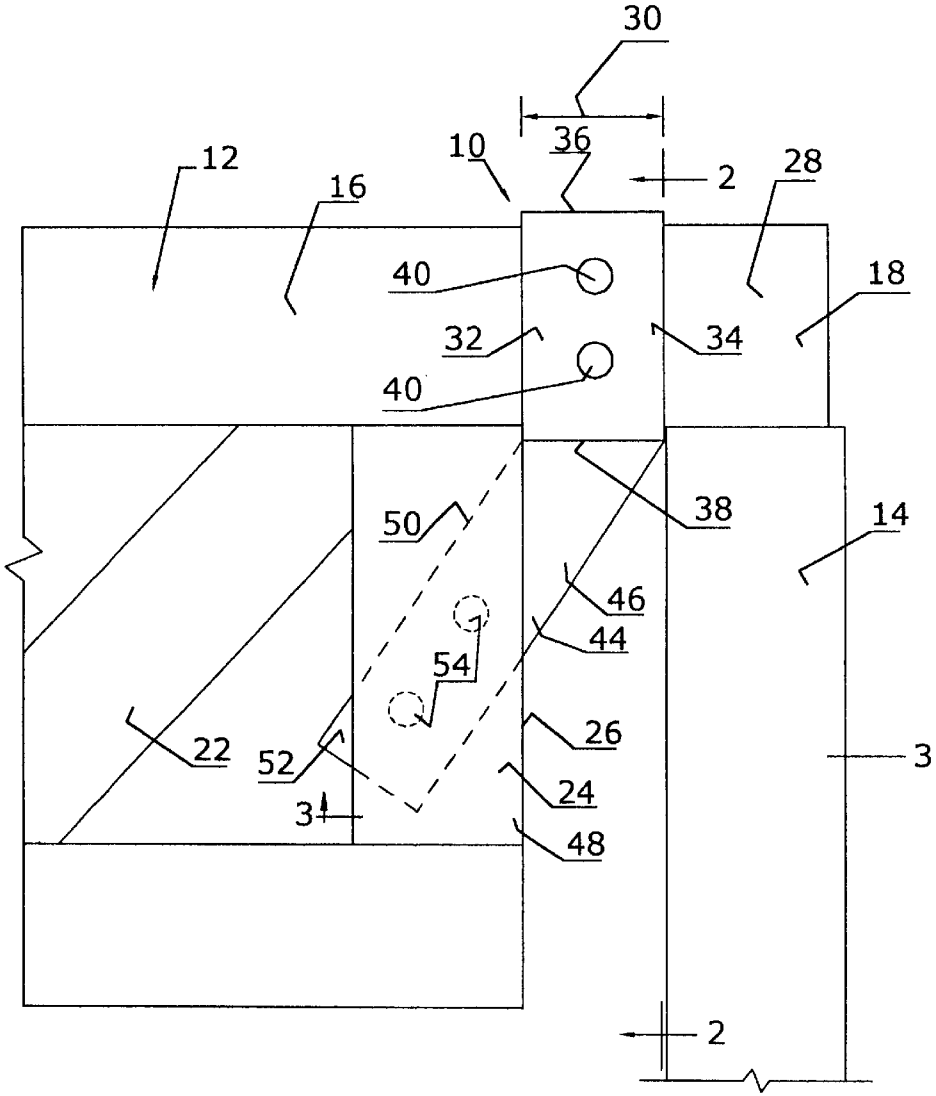
FIG. 1 is a side elevational view of the device according to the present invention.

When the mounting portions 28 are supported on a wall as shown in FIG. 1, a bearing offset 30 is defined between the end of the frame structure and the wall. The bracket 10 mounts on the rafter across the bearing offset and reduces the effect of the offset 30 for reinforcing the truss 12.

The bracket includes a clamp member 32 in the form of a channel of C-shaped cross section having a base 34 and top and bottom flanges 36 and 38 extending therefrom. The flanges 36 and 38 define a pair of opposing and engaging faces which are parallel and spaced apart for engaging opposite sides of the rafter.

Before the channel is mounted on the rafter, the width of the base member 34 is selected to substantially fill the complete width of the bearing offset 30 as shown in FIG. 1. The clamp member 32 is thus arranged to snugly fit around the rafter 16 such that engagement of the engaging faces against the rafter provides torsional support between the clamp member and the rafter while engagement of the top flange 36 on a top side of the rafter 16 provides a load bearing support.

A set of apertures 40 are provided in the base member for receiving fasteners therethrough such that the clamp member is secured to the rafter as shown in FIG. 2.

Figure 3:
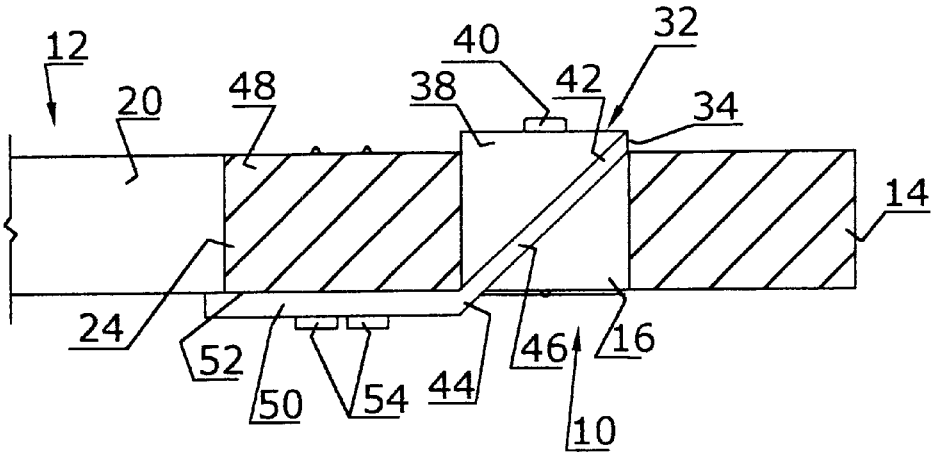
FIG. 3 is a partly sectional bottom view along the line 3—3 of FIG. 1.

The bottom flange 38 is triangular in shape as shown in FIG. 3 such that a free end 42 of the flange extends at an incline for mounting a strut anchor 44 thereon.

The strut anchor 44 includes a bent portion 46 in the form of a triangular plate which engages the free end 42 of the bottom flange along one side thereof and engaging a side of an outermost strut 48 along another side thereof for mounting a mounting portion 50 of the strut anchor thereon.

The mounting portion 50 comprises a flat and substantially rectangular plate having a mounting face 52 on an inner side thereof for engaging an outer side face of the outermost strut. The mounting face 52 is substantially perpendicular to the top flange 36 of the channel.

A set of mounting apertures 54 are located in the mounting portion 50 of the strut anchor spaced outwardly from the channel for receiving fasteners therethrough for securing the strut anchor to the outermost strut 48. In a closed truss design as shown in FIG. 1 the outermost strut comprises one of the posts 24 of the frame structure of the truss.

The bent portion 46 of the strut anchor is dimensioned and shaped such that when it lies flat, the strut anchor 44 and the clamp member 32 form a continuous strip of metal which is generally elongate and rectangular in shape. The bracket 10 is thus easily manufactured by manipulating a flat metal strip by bending and punching operations to form the bent portion 46, the channel and the respective mounting apertures 40 and 54. The use of steel for forming the channel and the strut anchor provide a rigid structure wherein the strut anchor is fixed in relation to the channel for reinforcing the wooden structure with added torsional and load bearing support between the channel and the strut anchor.

The bracket 10 may thus be used to strengthen and reinforce an existing truss, particularly when the bearing offset 30 is greater than a recommended tolerance. A bracket 10 is first selected by matching the width of the base member and corresponding flanges with the width off the bearing offset 30. The channel or clamp member 32 is then secured about the principle rafter between an end of the frame and an end of the rafter as shown in FIG. 1 using a pair of fasteners. Mounting the strut anchor 44 on an outermost one of the struts 48 thus provides additional load bearing support between the end of the frame structure of the truss and the end of the principle rafter while further providing torsional support therebetween.

Figure 4:
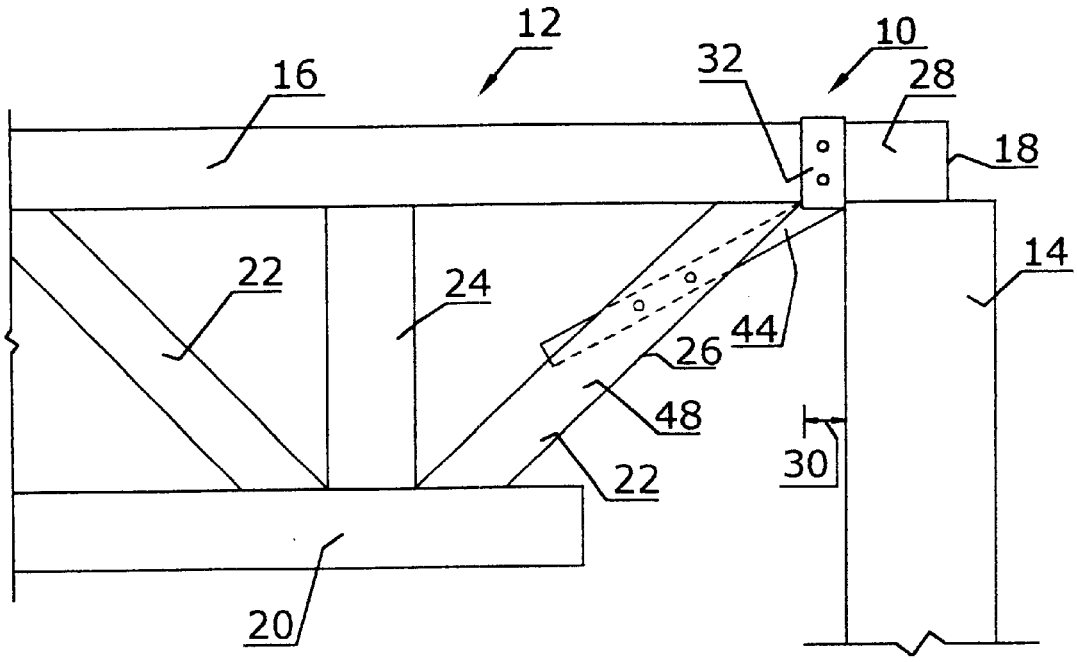
FIG. 4 is a side elevational view of an alternative embodiment according to the present invention.

In an alternative arrangement when using an open design of truss as shown in FIG. 4 the outermost strut comprises an incline support member extending between the beam 20 and the rafter 16. In this arrangement the bracket 10 is similar in design with the exception of the mounting portion of the strut anchor which extends at a sharper angle in relation to the rafter to ensure that the mounting portion overlaps the outermost strut which is extending at a downward and inward incline from the end of the rafter.

While particular embodiments of the present invention have been described in the foregoing, it is to be understood that other embodiments are possible within the scope of the invention. The invention is to be considered limited solely by the scope of the appended claims.

What is claimed is:

1. In combination with a building comprising a supporting structure including two, spaced apart bearing walls, a truss for supporting a roof on the supporting structure, the truss comprising:

an elongate frame structure;

a principal rafter extending longitudinally with the frame structure and past respective ends thereof, and having a pair of mounting portions located at respective ends of the principal rafter supporting the rafter on the bearing walls; and a reinforcement device comprising:

a channel receiving the principal rafter therein;

channel mounting means mounting the channel on the principal rafter between the frame structure and one of the mounting portions; and a rigid anchor secured to the channel and extending outwardly therefrom; and anchor mounting means mounting the anchor on the frame structure.

2. The combination according to claim 1 wherein there is provided a mounting face on the anchor for engaging a side of the frame structure and wherein the channel includes an engaging face which extends perpendicularly to the mounting face for engaging a top side of the principal rafter.

3. The combination according to claim 1 wherein the channel has a C-shaped cross section including a base member and a pair of side flanges extending therefrom which are parallel and spaced apart for engaging opposing sides of the principal rafter such that the rafter is secured therebetween.

4. The combination according to claim 3 wherein there is provided a mounting face on the anchor for engaging a side of the frame structure and wherein the channel is oriented such that the base member is substantially parallel to the mounting face of the anchor.

5. The combination according to claim 1 wherein the anchor mounting means are spaced from the channel.

6. The combination according to claim 1 wherein the channel and the anchor comprise an elongate rectangular plate which has been bent to define the channel and the anchor respectively.

7. The combination according to claim 1 wherein the channel mounting means comprises at least one aperture in the channel for receiving a corresponding fastener therethrough.

8. The combination according to claim 1 wherein the anchor mounting means comprises at least one aperture in the anchor for receiving a corresponding fastener therethrough.

9. A truss for supporting a roof on a supporting structure including two, spaced apart bearing walls, the truss comprising:

an elongate frame structure;

a principal rafter extending longitudinally with the frame structure and past respective ends thereof, and having a pair of mounting portions located at respective ends of the principal rafter for supporting the rafter on the bearing walls;

a channel mounted on and secured to the principal rafter between the frame structure and one of the mounting portions; and a rigid anchor extending between and secured to the channel and the frame structure; and wherein:

the frame structure includes a plurality of struts and an outermost pair of the struts define the respective ends of the frame structure;

the anchor is mounted on one of the outermost struts; and the outermost struts each comprise an inclined support member.

10. A truss for supporting a roof on a supporting structure, the truss comprising:

an elongate frame structure;

a principal rafter extending longitudinally with the frame structure and past respective ends thereof, defining a pair of mounting portions located at respective ends of the principal rafter for supporting the rafter on the supporting structure;

a channel mounted on one of the mounting portions of the principal rafter and securing the rafter therein, the channel comprising a clamp member of C-shaped cross section having a base and a pair of flanges extending therefrom for engaging respective sides of the principal rafter; and a rigid anchor extending between and secured to the channel and the frame structure.

11. A method of reinforcing an elongate truss having an elongate frame structure and an elongate principal rafter extending longitudinally with the frame structure past respective ends of the frame structure, the method comprising:

providing a bracket having a channel arranged to receive the principal rafter therein and an anchor for anchoring the bracket on the frame structure;

mounting the channel on the principal rafter between an end of the frame structure and an end of the rafter; and mounting the anchor on the frame structure;

wherein the principal rafter is supported at respective ends on a supporting structure and wherein the method includes selecting a channel having a width which is substantially equal to a spacing between one end of the frame structure and the supporting structure before the channel is mounted therebetween.

12. The method according to claim 11 wherein the method includes mounting the channel on the rafter such that a portion of the channel engages a top side of the rafter.

13. The method according to claim 11 wherein the truss includes a plurality of struts coupled to the principal rafter and wherein the method includes mounting the anchor on an outermost strut adjacent the corresponding end of the rafter mounting the channel thereon.

* * * * *